US007411516B2

(12) United States Patent
Jones et al.

(10) Patent No.: US 7,411,516 B2
(45) Date of Patent: Aug. 12, 2008

(54) WARNING SYSTEMS, DEVICES AND METHODS FOR RADIATION EMITTING DEVICES

(76) Inventors: David Brandon Jones, 160 Perrin Pl., Charlotte, NC (US) 28207; Russell G. Swagart, 6125 Rutledge Hill Rd., Columbia, SC (US) 29209; Amanda E. Peters, 5419 Nicklaus Dr., Rochester, MN (US) 55901; Robert D. Guenther, 1002 Queensferry Rd., Cary, NC (US) 27511; Ben E. Edwards, 1302 Willow Dr., Chapel Hill, NC (US) 27517

( * ) Notice: Subject to any disclaimer, the term of this patent is extended or adjusted under 35 U.S.C. 154(b) by 196 days.

(21) Appl. No.: 11/278,011

(22) Filed: Mar. 30, 2006

(65) Prior Publication Data

US 2006/0244586 A1 Nov. 2, 2006

Related U.S. Application Data

(60) Provisional application No. 60/667,017, filed on Mar. 31, 2005.

(51) Int. Cl.
*G08B 21/00* (2006.01)

(52) U.S. Cl. ..... 340/679; 340/815.4; 340/539.12; 340/691.6

(58) Field of Classification Search ..... 340/679, 340/680, 685, 539.12, 815.4
See application file for complete search history.

(56) References Cited

U.S. PATENT DOCUMENTS

| | | | | |
|---|---|---|---|---|
| 3,916,401 | A * | 10/1975 | Freeman | 340/666 |
| 4,954,813 | A * | 9/1990 | August et al. | 340/571 |
| 5,448,842 | A * | 9/1995 | Sonstroem | 40/331 |
| 5,710,543 | A * | 1/1998 | Moore | 340/691.7 |
| 6,057,785 | A * | 5/2000 | Guthrie | 340/904 |
| 6,067,011 | A * | 5/2000 | Leslie | 340/468 |
| 6,323,773 | B1 * | 11/2001 | Runyon et al. | 340/573.1 |
| 6,507,284 | B1 * | 1/2003 | Rothney | 340/693.5 |
| 6,529,126 | B1 * | 3/2003 | Henry | 340/467 |
| 6,650,242 | B2 * | 11/2003 | Clerk et al. | 340/573.1 |
| 7,064,673 | B1 * | 6/2006 | Bonham | 340/815.4 |
| 7,109,884 | B2 * | 9/2006 | Glynn | 340/907 |
| 2003/0043044 | A1 * | 3/2003 | Hunter | 340/573.4 |
| 2003/0214415 | A1 * | 11/2003 | Shaw | 340/685 |
| 2004/0196155 | A1 * | 10/2004 | Wilker et al. | 340/691.1 |
| 2005/0008829 | A1 * | 1/2005 | Suits | 428/195.1 |
| 2005/0057356 | A1 * | 3/2005 | Ehben et al. | 340/539.12 |

* cited by examiner

*Primary Examiner*—George A Bugg
*Assistant Examiner*—Eric M Blout
(74) *Attorney, Agent, or Firm*—Myers Bigel Sibley & Sajovec

(57) ABSTRACT

A warning system for displaying a warning that a device unit is in use includes a sign unit configured to display warning information. A device unit includes a communication module configured to provide a wireless communication between the device unit and the sign unit such that when the device unit is activated, the communication module automatically transmits a wireless warning signal to the sign unit instructing the sign unit to display the warning information.

21 Claims, 6 Drawing Sheets

WARNING SYSTEMS, DEVICES AND METHODS FOR RADIATION EMITTING DEVICES

RELATED APPLICATIONS

This application claims priority to U.S. Provisional Patent Application No. 60/667,017, filed Mar. 31, 2005, the disclosure of which is incorporated herein by reference in its entirety.

BACKGROUND OF THE INVENTION

The present invention relates to local warning systems and, more particularly, to automatic warning systems for use with portable radiation emitting devices.

Safety regulations governing the use of radiation emitting devices, such as class 3b and 4 lasers, typically require that a warning, sign be placed outside the door of any room in which a laser is being used. The warning sign may be removed when the emitting device is not in use to reduce the risk that the sign may be ignored. A technician may place a passive (e.g., unlit) sign on the door when the device is in use, but such a device may not draw sufficient attention to be noticed at all times. The technician may leave the sign in place continuously, which can increase the risk that the sign may be ignored. Technicians may also forget to place the sign on the door at all, leading to non-compliance with safety regulations and increased liability.

Active warning systems for laser use are available and typically use a hardwired connection from the laser to a sign on an access door to the room or enclosure in which the laser is used. When the laser is on, the warning sign on the door is illuminated. These systems may incorporate locks for the door and beam interrupters for the laser that activate if the door is open. These systems can require significant installation preparation, particularly when the laser is relocated. Mobile or semi-mobile radiation emitting devices may be disconnected and reconnected to a warning system when they are moved from one room to another. This process can be cumbersome and can increase laser operator or set-up errors.

SUMMARY

According to embodiments of the present invention, a warning system for displaying a warning that a device unit is in use includes a sign unit configured to display warning information. A device unit includes a communication module configured to provide a wireless communication between the device unit and the sign unit such that when the device unit is activated, the communication module automatically transmits a wireless warning signal to the sign unit instructing the sign unit to display the warning information.

According to some embodiments of the invention, a monitoring system includes a monitor configured to communicate with a plurality of warning systems as described above. The monitor is configured to display the warning information from a plurality of warning systems.

According to farther embodiments of the invention, a method for displaying a warning that a device unit is in use includes automatically transmitting a wireless warning signal from a device unit to a sign unit when the device unit is activated. Warning information is displayed on the sign unit when the sign unit receives the wireless warning signal.

DETAILED DESCRIPTION OF THE INVENTION

Figure 1:
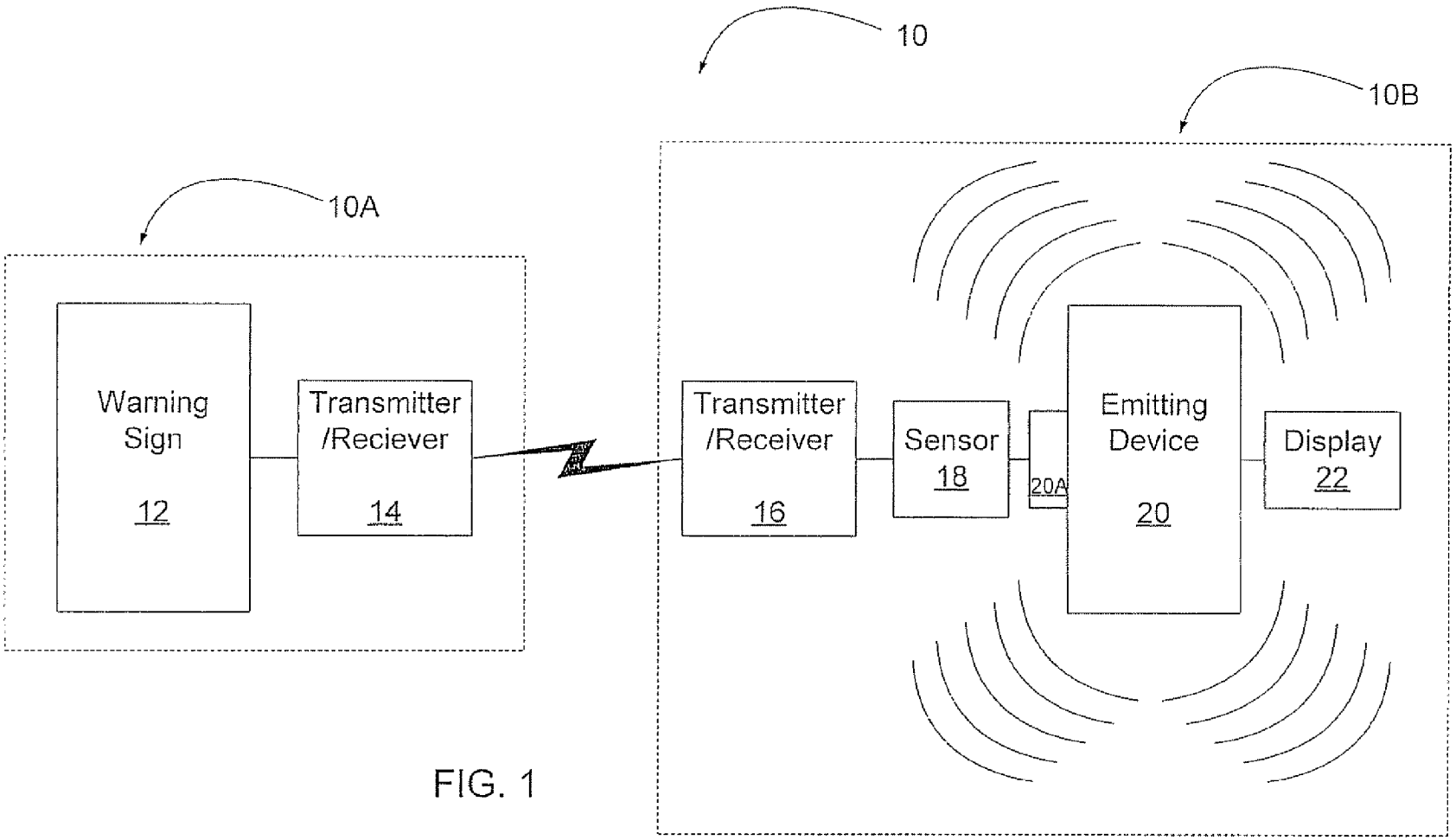
FIG. 1 is a schematic diagram of a warning system according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be farther understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a "first" element, component, region, layer or section discussed below could also be termed a "second" element, component, region, layer or section without departing from the teachings of the present invention. The sequence of operations (or steps) is not limited to the order presented in the claims or figures unless specifically indicated otherwise.

Certain embodiments of the present invention are described below with reference to block diagrams and/or flowchart illustrations of methods, apparatus (systems) and/or computer program products according to embodiments of the invention. It is understood that each block of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, the present invention may tale the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium include, but are not limited to, the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention include computer program products and/or hardware configured to implement techniques discussed herein.

A warning system 10 having a sign unit 10A and a mobile device unit 10B is illustrated in FIG. 1. The sign unit 10A includes a warning sign 12 and a communication module, such as one that includes a transmitter/receiver 14. The device unit 10B includes a communication module, such as a transmitter/receiver 16, a sensor 18, an emitting device 20 and a display 22. The emitting device 20 is any device that emits potentially harmful radiation, such as a class 3b or class 4 laser, X-ray machine, radiation treatment device, radiation from fluoroscopy and other X-ray sources as well as accelerators and radioisotopic sources. In operation, when the emitting device 20 is activated, the sensor 18 automatically receives a signal indicating that the emitting device 20 is active. In this configuration, the transmitter/receiver 16 transmits data to the transmitter/receiver 14, and the warning sign 12 can display relevant data and/or operational status.

The emitting device 20 can include an interlock port 20A that has an open circuit loop to prevent operation of the laser without a short circuit plug. When the device 20 is on, a current (e.g., about 5 mA) is present in the short circuit connection. This current can be detected by the sensor 18, indicating activation of the device 20. Interlock ports may be included on commercially available laser systems, such as class 3b and class 4 lasers. In some embodiments, such as in devices that do not have an interlock port, the sensor is connected to the power supply to detect the presence of current.

In some embodiments, the sensor 18 detects data indicating the status or operational characteristics of the emitting device 20, such as whether the device 20 is activated, the type of device, the type of radiation, and/or the type of precaution desired for operating the device 20, such as warnings of an increased risk for fire or other hazards. The information detected by the sensor 18 can be selected by an operator, for example, by inputting code during or after installation, or the information and/or settings can be added to the sensor 18 prior to installation, such as when the sensor 18 is manufactured. The system 10 can also be used to control traffic patterns in the area in which the device 20 is being used, such as in a surgical suite during a procedure. For example, for laser devices, the data can include information about the laser wavelength, the type of laser, and the class of laser. The warning sign 12, which displays information about the device 20, is typically placed on an entryway, such as a door, and can illuminate or display the information about the device 20, including the precautions for operating the device 20, such as specific types of eye protection based on the type of laser device being used.

In the configuration shown in FIG. 1, the transmitter/receiver 16 transmits data to the transmitter/receiver 14, and the warning sign 12 can display relevant data and/or operational status. The transmitter/receiver 14 transmits a confirmation back to the transmitter/receiver 16 that the device information has been received. The confirmation is displayed on the display 22. The display 22 can include a light source that illuminates to indicate sign activation; however, the display 22 can include some or all of the information displayed on the sign 12. In some embodiments, the display 22 is a terminal screen display. The operator of the emitting device 20 receives visual confirmation on the display 22 that the sign 12 is activated without requiring the operator to visually verify the activation of the sign on the door. In some embodiments, the emitting device 20 includes a safety lock that inhibits operation of the device if the activation of the sign 12 is not confirmed by the transmitter/receiver 16.

Accordingly, embodiments of the present invention can reduce operator actions required to display information on the sign 12 because "on/off" information and other information about the device 20 can be automatically sensed by the sensor 18 and wirelessly transmitted by the transmitter/receiver 16 to the sign 12. The operator can be provided with visual confirmation that the sign 12 is activated when the sign confirmation is displayed on the display 22. Moreover, mobile emitting devices 20 can be used in more than one room without significant set-up. For example, a sign unit 10A can be installed on the entryways to various rooms in which emitting devices 20 can be used. The devices 20 can be moved to various locations, and data about specific devices 20 and the respective "on/off" status may be transmitted to the appropriate sign unit 10A. For example, short range transmitter/receivers 14, 16 may be used so that only one sign unit 10A is within the range of the device 20 and the device transmitter/receiver 16. As another example, an operator can select a location of a device 20 (e.g., a room number in which the device 20 will be used), and the transmitter/receiver 16 can select and/or identify one of a plurality of sign units 10A based on the location of the device 20. The sign unit 10A can be permanently or semi-permanently installed or the sign unit 10A can also be moved between entryways.

The transmitter/receiver 14, 16 can be infrared (IR) transmitter/receivers; however, it should be understood that other types of wireless signals can be used, including Bluetooth technology or radiofrequency signals. In some embodiments, the signals are short range signals (e.g. IR or Bluetooth signals) that are generally limited to a finite area, such as the room in which the device 20 is located. Short-range signals may facilitate the use of multiple systems 10 with devices (such as the device 20) that can be interchanged in different rooms of a building or facility because the signals from one set of transmitter/receivers 14, 16 in one room may not interfere with another set of transmitter/receivers 14, 16 in another room.

Figure 2:
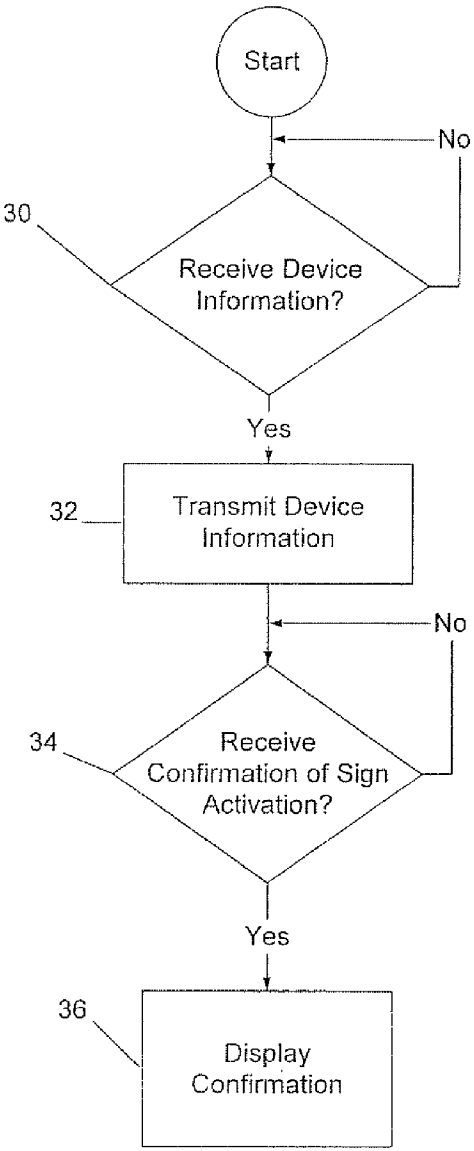
FIG. 2 is a flowchart illustrating operations of the mobile device unit of a warning system according to embodiments of the present invention.

Operations generally performed by the mobile device unit 10B are shown in FIG. 2. If the sensor 18 receives information about the device 20 (Block 30), then the sensor 18 sends the information to the transmitter/receiver 16, which transmits device data to sign unit 10A. If the transmitter/receiver 16 receives confirmation (e.g., from the sign unit 10A) that the sign has been activated (Block 34), then the display 22 can display the confirmation.

Figure 3:
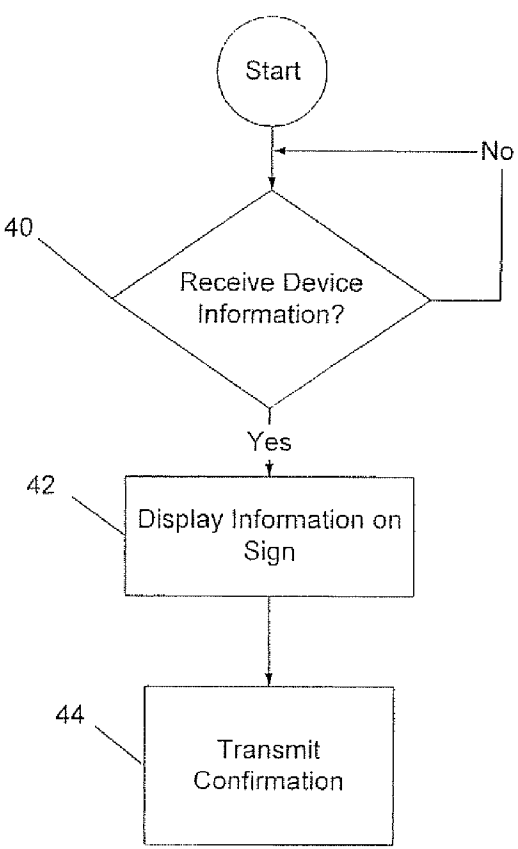
FIG. 3 is a flowchart illustrating operations of the sign unit of a warning system according to embodiments of the present invention.

Operations generally performed by the sign unit 10A are shown in FIG. 3. If the device information is received (Block 40) by the sign unit 10A, then the information is displayed on the sign 12 (Block 42). A confirmation that the information has been received and displayed on the sign 12 is transmitted to the device unit 10B (Block 44).

Figure 4:
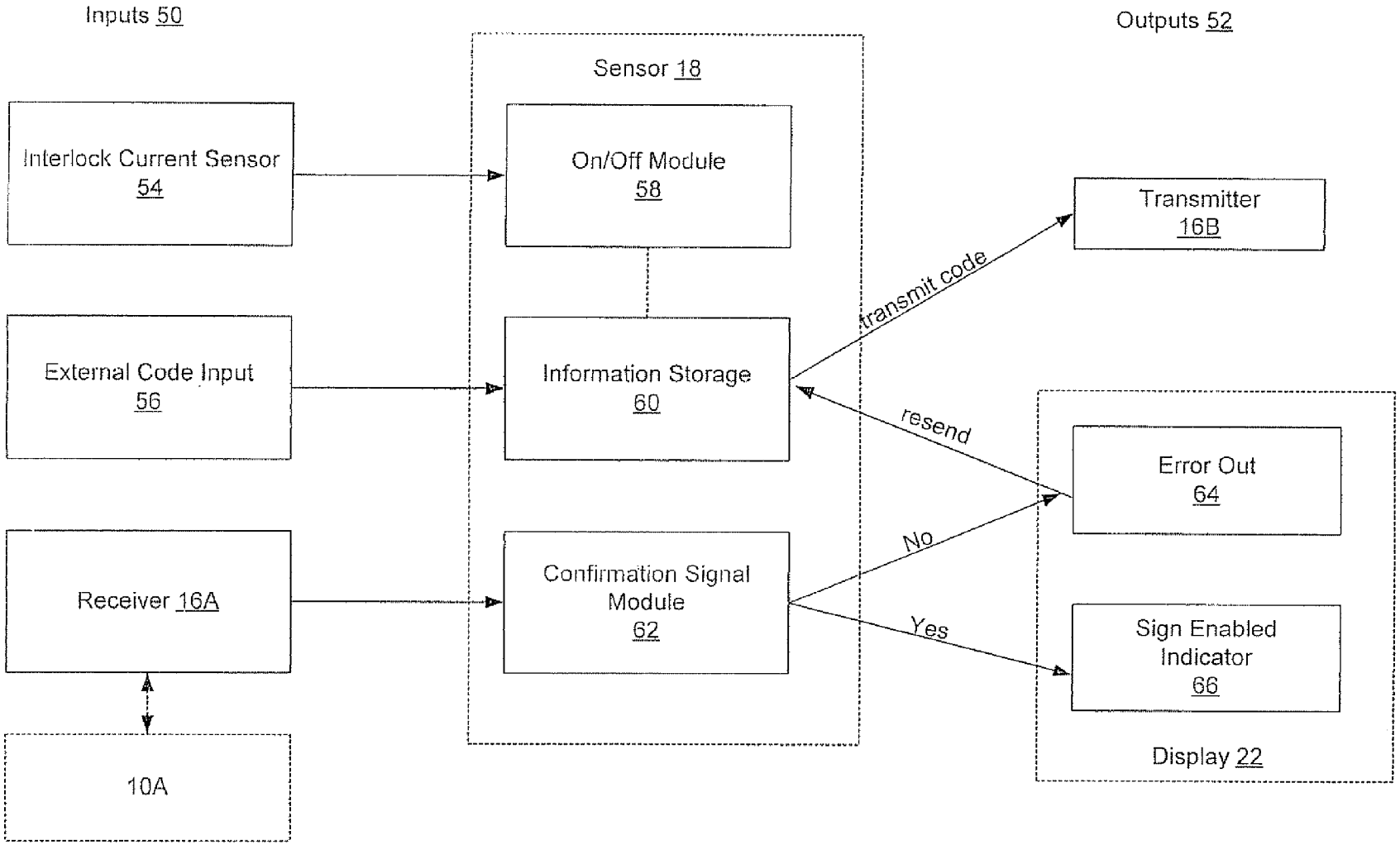
FIG. 4 is a schematic diagram of a system with a sensor for an emitting device according to embodiments of the present invention.

Exemplary inputs 50 and outputs 52 to the sensor 18 and/or the display 22 are illustrated in FIG. 4. The inputs 50 can include an electronic interlock sensor 54, external code input 56, and a receiver 16A. The sensor 18 can include an on/off module 58, information storage 60 and a confirmation signal module 62. The outputs 52 can include a transmitter 16B, and the display 22. The display 22 can have an "error out" indicator 64 and a "sign enabled" indicator 66.

The interlock sensor 54 can be configured to detect a current on the interlock 20A of the emitting device 20 (FIG. 1), which indicates that the emitting device 20 is activated, and conveys the on/off information to the on/off module 58 of the sensor 18. The external code input 56 collects and/or provides information about the particular emitting device in communication with the sensor 18. The code input 56 can be a keypad or other user-input device that receives information entered by an operator, or the emitting device 20 can be configured to electronically or wirelessly send information automatically to the code input 56. The information storage 60 can receive data regarding the device 20 from the on/off module 58 and the external code input 56. The information from the information storage 60 is transmitted by the transmitter 16B.

The receiver 16A, which together with the transmitter 16B can comprise the receiver/transmitter 16 in FIG. 1, can receive a signal from the sign unit 10A confirming that the sign 12 has been activated. If the confirmation signal is received, then the confirmation signal module 62 instructs the display 22 to activate the sign enabled indicator 66. As a result, the operator of the emitting device 20 knows that the sign has been enabled and that he/she can proceed to operate the emitting device 20. In some embodiments, the confirmation signal module 62 prohibits operation of the device 20 until the confirmation signal is received. If the confirmation signal is not received from sign unit 10A and the interlock current sensor 54 indicates that the emitting device has been enacted, then an error signal can be automatically electronically sent to the display 22 and the error out indicator 64 can be activated. The error out indicator 64 can visually or audibly alert the operator that the sign unit 10A has not been enacted. The operator can then take appropriate action, such as to manually activate the warning sign. If the confirmation signal module 62 places a safety lock to prohibit operation of the device 20 when the sign unit 10A is not activated, the operator can manually activate the warning sign and manually override the safety lock. The sign enabled indicator 66 and the error out indicator 64 can be any type of display for displaying information, including a light display, such as an LCD.

Figure 5:
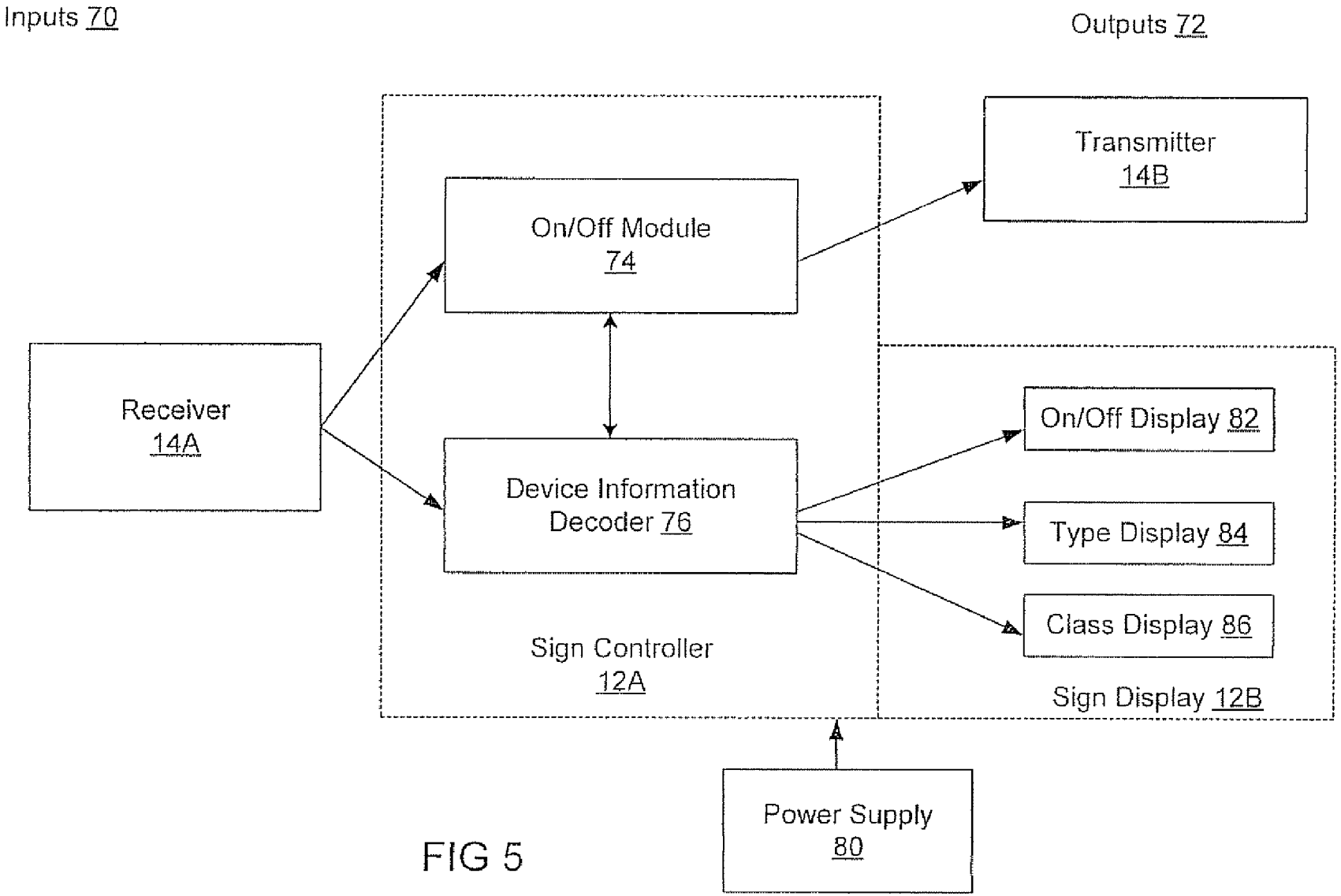
FIG. 5 is a schematic diagram of a system with a warning sign according to embodiments of the present invention.

Input 70 and outputs 72 for a sign controller 12A are illustrated in FIG. 5. The sign controller 12A is configured to control the operations of the sign 12 of FIG. 1. With continued reference to FIG. 5, signals from a receiver 14A are input to the sign controller 12A. The outputs 72 include a transmitter 14B (which together with the receiver 14A can provide the receiver/transmitter 14 in FIG. 1), an on/off display 82, a type display 84 and a class display 86. A power supply 80 is connected to the sign controller 12A. The signals from the receiver 14A can include an on/off indication transmitted to the on/off module 74 and/or information, such as code, transmitted to the decoder 76. In some embodiments, codes are transmitted to the receiver 14A. The codes correspond to device data, which is interpreted by the decoder 76. The device data is then displayed by the sign 12 of FIG. 1 such as by using the on/off display 82, the type display 84 and the class display 86. The on/off display 82, the type display 84 and/or the class display 86 can be any type of display for displaying information, including a light display, such as an LCD or an electronic screen display, such as a terminal screen. When the emitting device 20 status information and/or data has been displayed, the transmitter 14B can transmit a confirmation signal to the device unit 10B.

Figure 6:
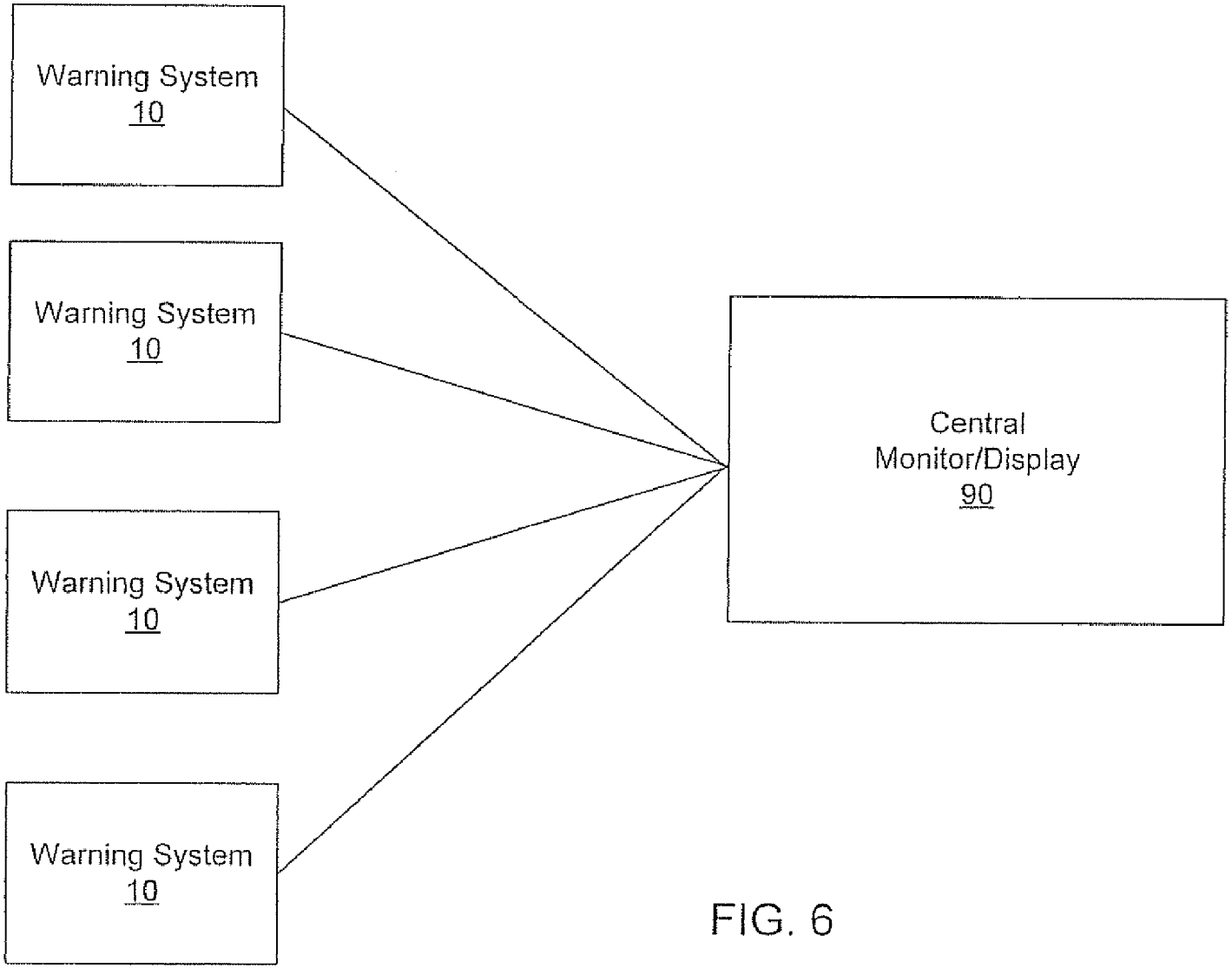
FIG. 6 is a schematic diagram of a plurality of warning systems connected to a central monitor/display according to embodiments of the present invention.

As shown in FIG. 6, a plurality of warning systems 10 can be connected to a central monitor/display 90. In this configuration, the warning systems 10 can be monitored by the central monitor/display 90 and information regarding the types of device emitters, the location of the emitters, and/or the activation status can be conveyed and displayed by the central monitor/display 90. The warning systems 10 can be connected to the monitor/display 90 by a wireless or wired connection. For example, the sign unit transmitter/receiver 14 can transmit data to the monitor/display 90.

In some embodiments, the central monitor/display 90 may be used to monitor the amount that one or more devices provided in the warning systems 10 is used, for example, for billing purposes in a hospital environment.

Figure 7:
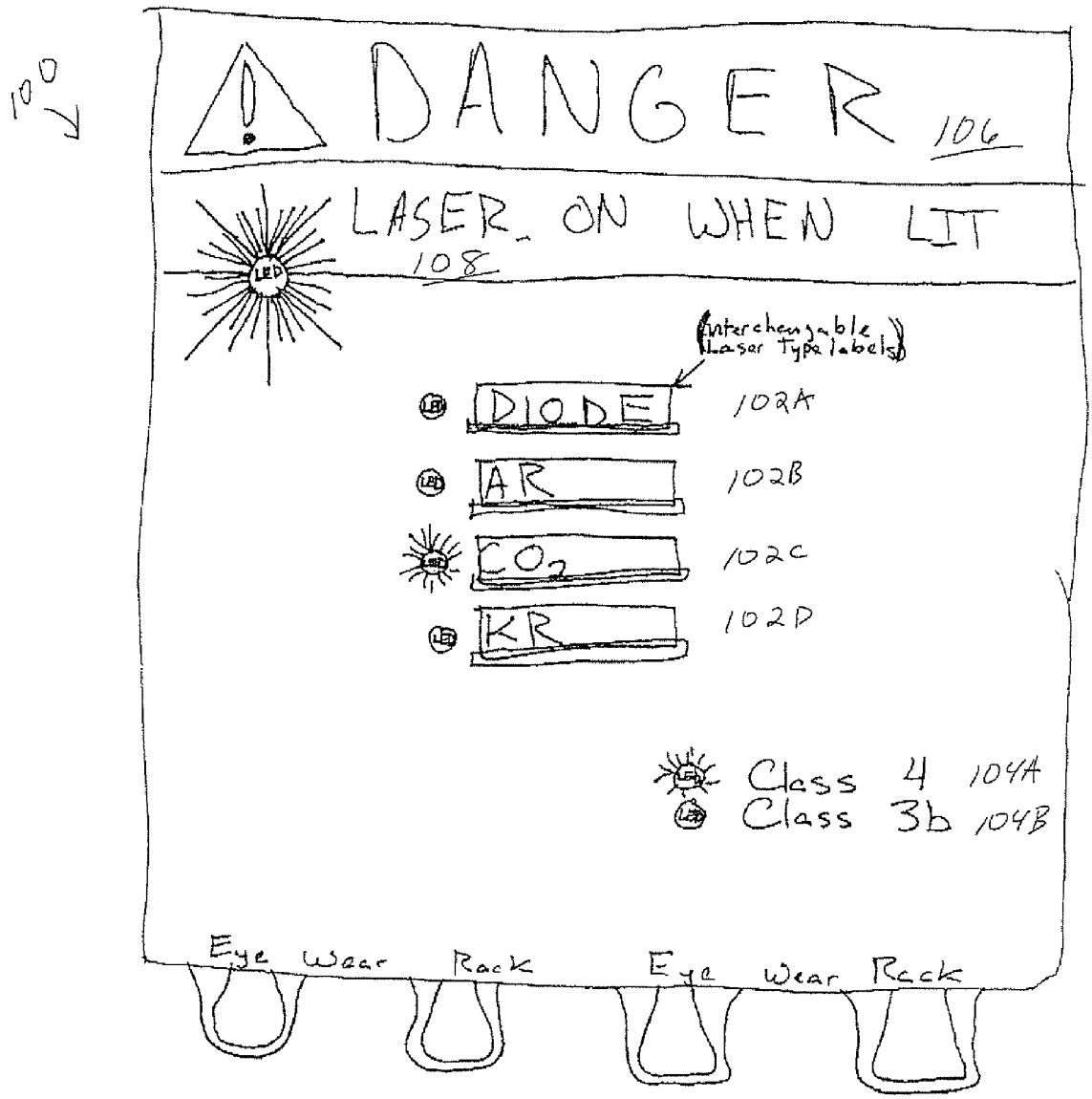
FIG. 7 is a front view of an exemplary warning display sign according to embodiments of the present invention.

An exemplary sign unit 100 is illustrated in FIG. 7. The sign unit 100 includes displays 102A, 102B, 102C, 102D, 104A and 104B corresponding to a type of emitting device. The displays 102A, 102B, 102C, 102D, 104A and 104B can be separate lines or segments or can be combined to form a common display. As illustrated, the displays 102A, 102B, 102C and 102D indicate the type of laser being used (i.e., a diode laser, an Argon (Ar) laser, a Carbon Dioxide ($CO_2$) laser, or a Krypton (Kr) laser). The displays 104A and 104B indicate if the laser is a class 4 or a class 3b laser. The sign unit 100 also includes a "Danger" display 106 and a "Laser On" display that that illuminates or has increased external visibility when the laser is on.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A warning system for displaying a warning that a device unit is in use, the system comprising:

a sign unit configured to display warning information; and a device unit including a communication module configured to provide a wireless communication between the device unit and the sign unit such that when the device unit is activated by emitting radiation, the communication module automatically transmits a wireless warning signal that is different from the radiation emitted by the device unit to the sign unit instructing the sign unit to display the warning information.

2. The warning system of claim 1, wherein the sign unit comprises a sign unit communication module, wherein the sign unit communication module is configured to transmit a wireless confirmation signal to the device unit communication module when the sign unit displays the warning information.

3. The warning system of claim 2, wherein the device unit comprises a display configured to indicate that the wireless confirmation signal has been received from the sign unit communication module.

4. The warning system of claim 2, wherein the device unit comprises a safety lock that inhibits operation of the device unit if the wireless confirmation signal has not been received.

5. The warning system of claim 1, wherein the device unit includes a sensor configured to detect when the device unit is activated.

6. The warning system of claim 5, wherein the sensor is configured to detect a current in a power source of the device unit.

7. The warning system of claim 5, wherein the sensor is configured to detect a current in a circuit of the device unit that indicates that the device unit is in use.

8. The warning system of claim 1, wherein the device unit includes an emitting device that is configured to emit radiation.

9. The warning system of claim 1, wherein the warning information includes information characterizing a form of radiation emitted when the device unit is activated as being one of a plurality of radiation types.

10. A monitoring system comprising:

a monitor configured to communicate with a plurality of warning systems, each of the warning systems comprising:

a sign unit configured to display warning information; and a device unit including a communication device configured to provide a wireless communication between the device unit and the sign unit such that when the device unit is activated, the communication device automatically transmits a wireless warning signal to the sign unit instructing the sign unit to display the warning information;

wherein the monitor is configured to display the warning information from a plurality of warning systems.

11. The monitoring system of claim 10, wherein the monitor is configured to determine an amount of usage for the device unit.

12. A method for displaying a warning that a device unit is in use, the method comprising:

automatically transmitting a wireless warning signal from a device unit to a sign unit when the device unit is activated by emitting radiation, wherein the wireless warning signal is different from the radiation emitted by the device unit; and displaying warning information on the sign unit when the sign unit receives the wireless warning signal.

13. The method of claim 12, further comprising transmitting a wireless confirmation signal to the device unit when the sign unit displays the warning information.

14. The method of claim 13, further comprising displaying an indication that the wireless confirmation signal has been received from the sign unit.

15. The method of claim 13, further comprising inhibiting operation of the device unit if the wireless confirmation signal has not been received.

16. The method of claim 12, further comprising detecting when the device unit is activated.

17. The method of claim 16, wherein detecting when the device unit is activated includes detecting current in a power source of the device unit.

18. The method of claim 16, wherein detecting when the device unit is activated includes detecting a current in a circuit of the device unit that indicates that the device unit is in use.

19. The method of claim 12, wherein the device unit emits radiation when the device unit is activated.

20. The method of claim 18, wherein the warning information includes information characterizing a form of radiation emitted when the device unit is activated as being one of a plurality of radiation types.

21. A warning system for displaying a warning that a device unit is in use, the system comprising:

a sign unit configured to display warning information; and a laser device unit including a communication module configured to provide a wireless communication between the laser device unit and the sign unit such that when the laser device unit is activated, the communication module automatically transmits a wireless warning signal to the sign unit instructing the sign unit to display the warning information, wherein the warning information identifies a type of laser radiation emitted when the laser device unit is activated.

* * * * *